US008042314B2

(12) United States Patent
Forster

(10) Patent No.: US 8,042,314 B2
(45) Date of Patent: Oct. 25, 2011

(54) CONSTRUCTION FOR BUILDINGS PROTECTED AGAINST RADIATION

(76) Inventor: Jan Forster, Ingolstadt (DE)

( * ) Notice: Subject to any disclaimer, the term of this patent is extended or adjusted under 35 U.S.C. 154(b) by 0 days.

(21) Appl. No.: 12/639,646

(22) Filed: Dec. 16, 2009

(65) Prior Publication Data

US 2010/0154348 A1 Jun. 24, 2010

Related U.S. Application Data

(62) Division of application No. 10/542,155, filed on Feb. 13, 2006, now abandoned.

(30) Foreign Application Priority Data

Jan. 13, 2003 (DE) ..... 103 01 041
Jun. 18, 2003 (DE) ..... 103 27 466
Dec. 29, 2003 (EP) ..... PCT/EP2003/014941

(51) Int. Cl.
*E04B 2/84* (2006.01)
*E04B 2/92* (2006.01)
*E04B 2/26* (2006.01)

(52) U.S. Cl. ..... 52/783.1; 52/782.1; 52/796.1; 52/506.01; 52/419; 52/425; 52/438; 52/427

(58) Field of Classification Search ..... 52/782.1, 52/506.01, 309.7–309.17, 415–442, 518.1, 52/517.1, 404.1–404.5, 405.1–405.4, 406.1–406.3, 52/407.1–407.5, 796.1, 783.1, 309.1
See application file for complete search history.

(56) References Cited

U.S. PATENT DOCUMENTS

| | | | | |
|---|---|---|---|---|
| 2,321,449 | A | 6/1943 | Armao | |
| 2,589,021 | A | 3/1952 | O'Neal | |
| 2,655,710 | A | 10/1953 | Burns et al. | |
| 2,694,025 | A | 11/1954 | Games et al. | |
| 3,284,980 | A | 11/1966 | Dinkel | |
| 3,943,676 | A * | 3/1976 | Ickes | 52/309.12 |
| 3,965,635 | A | 6/1976 | Renkert | |
| 4,074,141 | A | 2/1978 | Bryant | |
| 4,104,842 | A * | 8/1978 | Rockstead et al. | 52/649.1 |
| 4,702,053 | A * | 10/1987 | Hibbard | 52/309.7 |
| 4,774,045 | A | 9/1988 | Kushida et al. | |
| 4,825,089 | A | 4/1989 | Lindsay | |
| 5,564,498 | A * | 10/1996 | Bochard | 165/169 |
| 5,842,314 | A | 12/1998 | Porter | |
| 5,937,598 | A * | 8/1999 | Rain | 52/204.591 |
| 6,202,375 | B1 * | 3/2001 | Kleinschmidt | 52/309.11 |

(Continued)

FOREIGN PATENT DOCUMENTS

DE 2940887 A1 4/1982

(Continued)

OTHER PUBLICATIONS

Patent Abstract of Japan No. 03013895, Jan. 22, 1991.

(Continued)

*Primary Examiner* — Jeanette E. Chapman
(74) *Attorney, Agent, or Firm* — Dority & Manning, P.A.

(57) ABSTRACT

In a construction with walls, ceilings, and/or floors as parts of the building, especially for buildings protected against radiation, the parts of the building are made of reinforced concrete. One part of the building may be a sandwich design wherein one layer is made of a material that protects against radiation, and at least one layer is made of concrete.

13 Claims, 3 Drawing Sheets

U.S. PATENT DOCUMENTS

| | | | | |
|---|---|---|---|---|
| 6,226,942 | B1 * | 5/2001 | Bonin | 52/309.12 |
| 6,272,805 | B1 * | 8/2001 | Ritter et al. | 52/309.11 |
| 7,493,738 | B2 * | 2/2009 | Bui | 52/783.11 |
| 2004/0040257 | A1 | 3/2004 | Bui | |
| 2004/0217307 | A1 | 11/2004 | Bruchle et al. | |

FOREIGN PATENT DOCUMENTS

| | | | |
|---|---|---|---|
| DE | 240090 | A1 | 10/1986 |
| DE | 3607190 | A1 | 9/1987 |
| DE | 3629335 | A1 | 3/1988 |
| DE | 10120368 | A1 | 11/2002 |
| GB | 2217631 | A | 11/1989 |
| RU | 2102802 | C1 | 1/1998 |

OTHER PUBLICATIONS

Patent Abstract of Japan No. 02268298, Jan. 11, 1990.
Patent Abstract of Japan No. 08201582, Aug. 9, 1996.
PCT Search Report, Mar. 31, 2004.
German Patent Office Search Report, Jul. 21, 2004.
International Preliminary Examination Report, Aug. 23, 2005.

* cited by examiner

CONSTRUCTION FOR BUILDINGS PROTECTED AGAINST RADIATION

RELATED APPLICATION

The present application is a Divisional Application of U.S. application Ser. No. 10/542,155 having a filing date of Feb. 13, 2006.

FIELD OF THE INVENTION

The invention relates to a construction with walls, ceilings, and/or floors as parts of the building, especially for buildings protected against radiation in which the parts of the building are made of reinforced concrete.

BACKGROUND

Buildings protected against radiation are necessary for example in the field of medicine with rooms in which radiation occurs, i.e. proton treatment rooms, that must be shielded so that the radiation cannot leave the treatment room. In a known design, extremely thick, solid, reinforced concrete walls are used for the rooms. Such a design is extremely expensive, and in addition, dismantling the building requires a great deal of effort.

In certain circumstances, dismantling is necessary since the proton treatment equipment has a limited service life and is usually leased because it is so expensive. The time at which the devices are dismantled and hence (in certain circumstances) the building is dismantled can be predicted.

SUMMARY

An object of the present invention is therefore to create an economical construction, especially for radiation rooms, that meets the high demands of radiation screening and that may be dismantled economically if necessary. Additional objects and advantages of the invention will be set forth in part in the following description, or may be obvious from the description, or may be learned through practice of the invention.

According to the invention, the part of the building of the construction is manufactured in a sandwich design. With its sandwich design, the building part has one layer of a material that protects against radiation and at least one layer of concrete. The concrete layer primarily serves as a type of shell for holding the antiradiation material. In addition, if the concrete layer is correspondingly designed, the concrete layer can also help screen against radiation, In a particularly preferred embodiment, the material that protects against radiation is on the side of the concrete layer facing away from the radiation room.

Water, especially bound water, has proven to be a particularly effective material to protect against radiation. To prevent moisture in the rooms, the water is bound to a solid material, and usually at least the same anti-radiation effect arises as with unbound water.

It is particularly advantageous when the anti-radiation material is natural, unfired calcium sulfate dihydrate. Calcium sulfate dihydrate is natural gypsum, and is particularly suitable as an anti-radiation material because it binds water particularly well.

An easy and fast mode of assembly is to slide into a cavity anti-radiation material made of gypsum panels that can be free-standing or mortared in. This type of construction is particularly advantageous for large, straight walls.

To make construction particularly easy, the antiradiation material is pourable hardened granular gypsum. Gypsum in this form is easy to manufacture, transport and process.

When the particle size of the gypsum granules is 40 mm and below, the granules can be easily and compactly poured into the provided cavities. Such a particle size can be economically manufactured.

The antiradiation material is advantageously compressed. This prevents undesirable cavities from arising in unfavorable circumstances that could impair the protection from radiation.

If the layer thickness of the anti-radiation material is selected as a function of the radiation intensity to be screened, different radiation protection can be achieved with the same material.

It is advantageous when additives consisting of gibbsite, hydragillite, aluminum hydrate or magnesium sulfate are added to the anti-radiation material. This can increase the protective effect.

When the antiradiation material is poured between a construction pit structure, in particular a sheet piling wall, and the concrete layer is poured in and possibly compressed, it achieves effective radiation protection for the environment, such as the groundwater.

It is particularly advantageous when the antiradiation material is between two layers of concrete. The antiradiation material can be easily and quickly set up, which makes building the construction faster and more economical.

If the concrete layer is made of a two-shell double wall, prefabricated concrete parts can be used for particularly fast and economical construction. The use of prefabricated concrete parts is particularly advantageous and an inventive embodiment of the invention.

Filling the double wall with site-mixed concrete produces a compact and heavy concrete layer that creates a wall which can undergo high static stress, and this additionally increases radiation protection.

It is particularly advantageous when heavy concrete with heavy media additives such as hematite, lead, steel or iron materials are used for the concrete layer and/or the site-mixed concrete to fill the double wall. Radiation protection is increased by iron additives that for example can be scrap iron granules.

If the building part consists of two spaced double walls, and if the space between the two double walls is filled with anti-radiation material, it is particularly economical to construct the radiation protection wall with a sandwich design. The double walls serve as permanent framework for the site-poured concrete that fills the gap between the two walls. The two double walls also serve as a permanent framework for the actual antiradiation material.

If the double walls are connected with tie rods running perpendicular to their lengthwise extension, the double walls are prevented from bulging when the antiradiation material is poured in, and the static strength of the double walls and concrete layer is increased.

The double wall is advantageously made of prefabricated concrete panels with essentially parallel, spaced walls. The individual walls are connected in particular with wall lattice girders. Such double walls are relatively easy to make and transport.

If the connecting elements for two double wall elements and/or one double wall element and a ceiling element are welded or screwed together, it produces a stable shell for pouring concrete into the cavity between the wall elements to yield a uniform, seamless concrete layer.

If the wall lattice girders between the wall elements are corrosion-resistant or are made of high-grade steel, impermissible corrosion and static weakness to the concrete layer are prevented.

To screen the construction from the earth, the construction is advantageously built of anti-radiation material. This protects the groundwater from radiation.

Other advantages of the invention are described in the following exemplary embodiments.

DESCRIPTION

Figure 1:
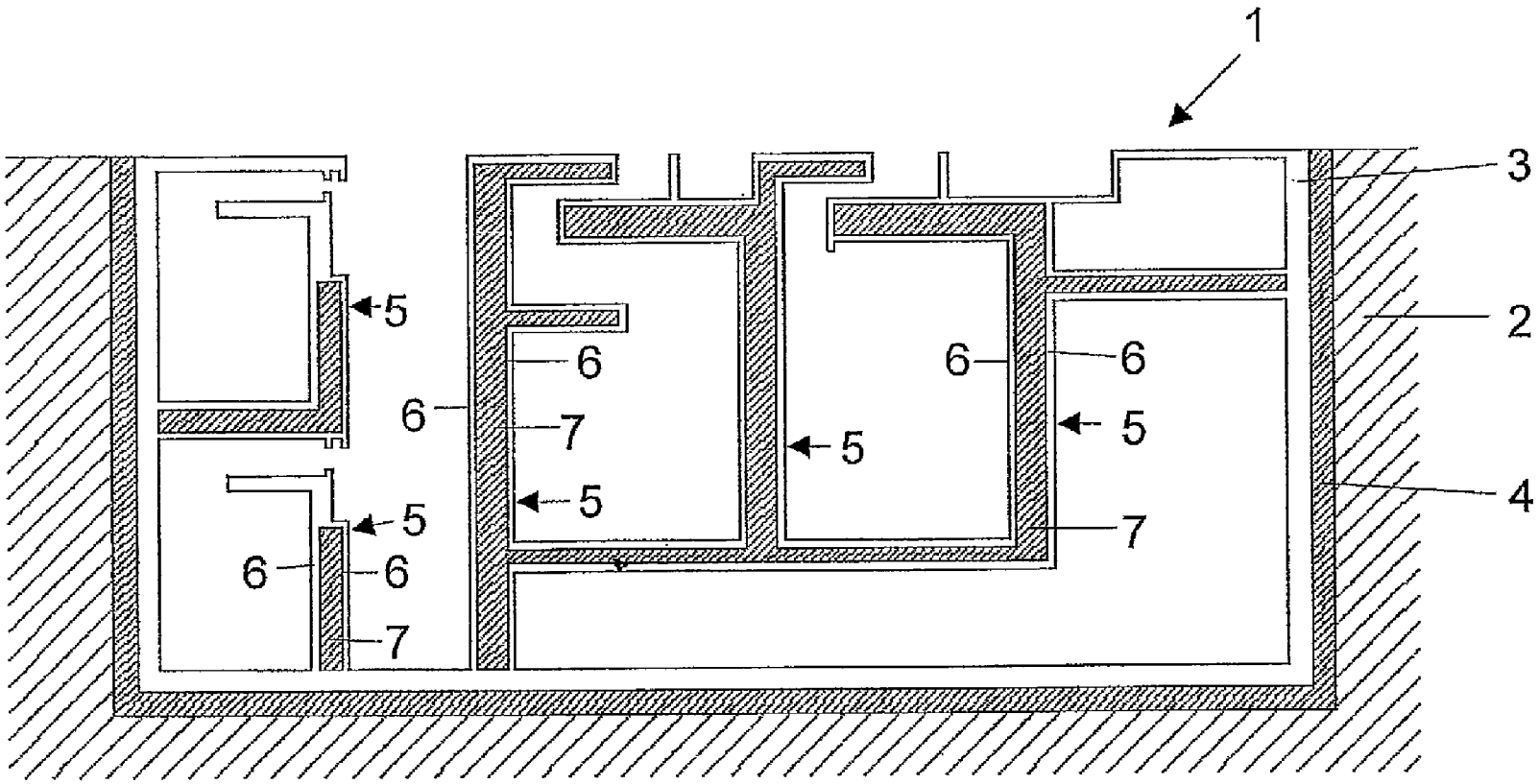
FIG. 1 shows a plan of construction according to the invention.

Reference is now made to particular embodiments of the invention, one or more examples of which are illustrated in the drawings. Each embodiment is provided by way of explanation of the invention, and not as a limitation of the invention. For example, features illustrated as described as part of one embodiment may be used with another embodiment to yield still a further embodiment. It is intended that the present invention include these and other modifications and variations.

The plan in FIG. 1 shows a construction (1) manufactured according to the invention. The construction (1) is surrounded by soil (2) on three sides. An outer wall (3) of the construction (1) is at a distance from the soil (2). A gypsum shell (4) is between the outer wall (3) and the soil (2). The gypsum shell (4) is the anti-radiation layer and provides the basic radiation protection of the construction (1) to the outside.

The gypsum material used for the gypsum shell (4) consists of natural, unfired calcium sulfate hydrate, and is poured in the form of hardened, granulated gypsum between the outer wall (3) and the soil (2); or a sheet pile wall installed during construction that retains the soil (2). The sheet pile wall is removed after the gypsum material is poured into the gap, and compressed if applicable. The gypsum shell (4) is given a specific thickness, resulting from the specific distance between the sheet pile wall and the outer wall (3) to provide a specific radiation protection for the environment. The construction (1) in which radiation is generated is therefore screened from the environment to prevent damage to the environment.

The outer wall (3) preferably consists of a concrete layer of heavy concrete that can contain iron additives to additionally provide radiation protection for the environment.

Another type of sandwich design is provided for the inner walls (5) of the construction (1). Two concrete layers (6) are provided at a distance from each other. Antiradiation material, preferably in the form of gypsum, is poured between the concrete layers (6). The granulated gypsum with a diameter less than 40 mm, in a particularly preferable embodiment, is poured into the gap between the two concrete layers (6) and possibly compressed.

Alternately or additionally, gypsum panels can be installed instead of the granules. This can provide additional stability and in certain circumstances improve radiation protection. In some designs, the gypsum panels can be installed more quickly and economically.

Figure 3:
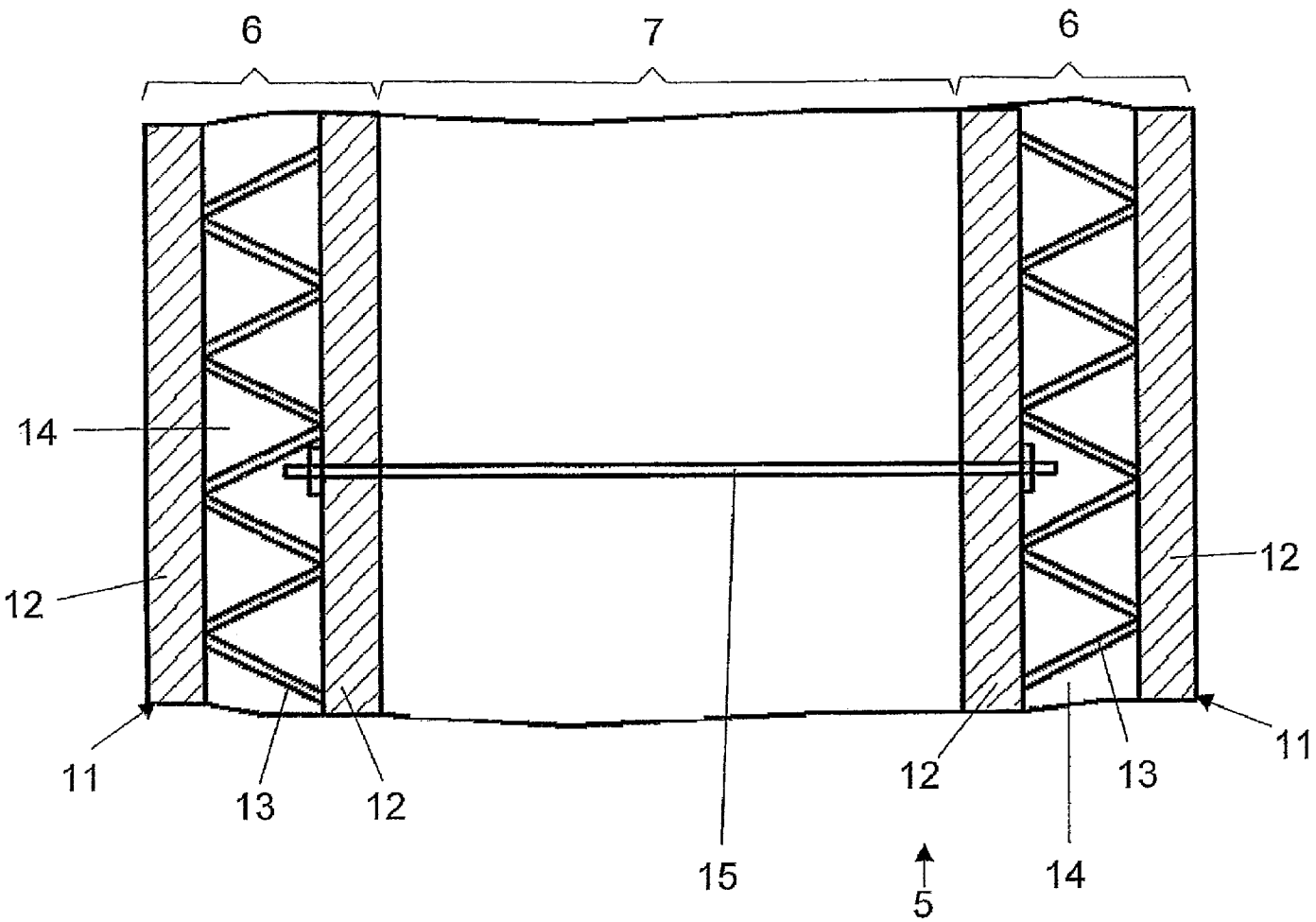
FIG. 3 shows a cross-section of a sandwich construction according to the invention with double concrete walls.

The gypsum has a large amount of bound water and is therefore highly suitable as antiradiation material. The thickness of the gypsum or antiradiation layer can be selected as a function of the desired radiation protection. A thicker gypsum layer provides greater protection of neighboring rooms, and a thinner gypsum layer is sufficient when less screening is desired. Additives such as hydragillite, aluminum hydrate or magnesium sulfate can be added to the gypsum (7) to improve radiation protection. However, this is only necessary if extremely high radiation protection is required. The concrete layer (6) can either be made of site-mixed concrete that can be heavy concrete with iron additives, or it can consist of the double walls as shown in FIG. 3.

Figure 2:
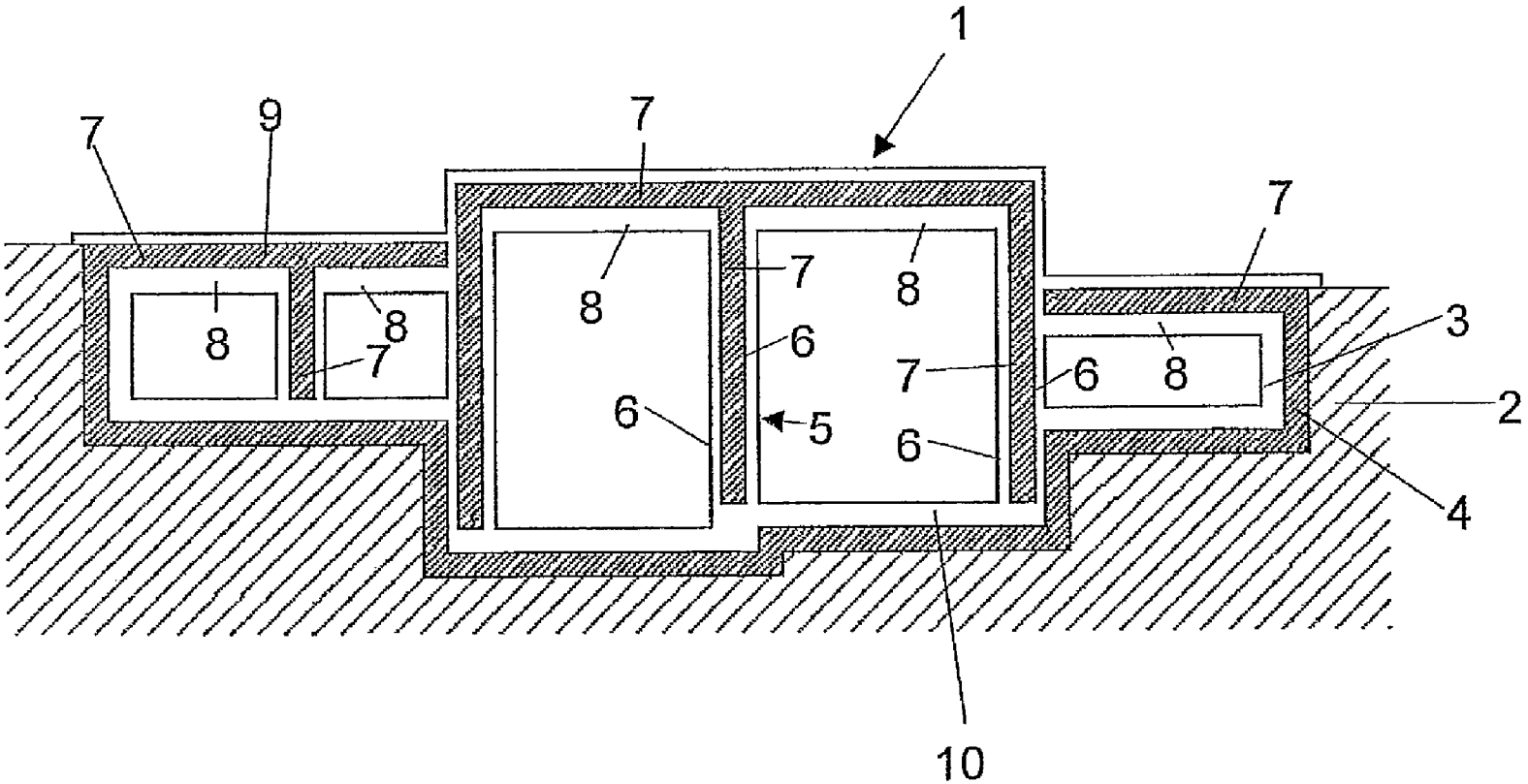
FIG. 2 shows a cross-section of a construction according to the invention.

FIG. 2 shows a section of a construction (1) according to the intention. The construction (1) is buried in the earth (2). In this case as well, the gypsum shell (4) also surrounds the building, protecting it from the earth (2), and prevents the radiation generated in the construction (1) from entering the earth (2). This reliably prevents groundwater from being irradiated. The inner walls (5) of the construction (1) also consist of two concrete layers (6) and the gypsum (7) between them. A ceiling (8) lies on the concrete layers (6) and covers the top of the respective room of the construction (1).

To provide radiation protection for the interior in all directions, an additional gypsum ceiling (9) is above the ceiling (8). The gypsum ceiling (9) prevents radiation from exiting upward. The area above the gypsum ceiling (9) can be for normal uses such as a lawn or parking area.

To prevent an impermissible cavity from arising as a result of the gypsum (7) settling between the inner walls (5), the gypsum ceiling (9) is poured over the ceiling openings between the concrete layers (6). Material from the gypsum ceiling (9) will penetrate the gaps between the concrete layers (6) if the gypsum (7) between the concrete layers (6) actually settles. Settling can however be avoided if the gypsum (7) is compressed when it is poured to give it a lasting density.

The construction (1) is built on a floor slab (10) that rests on the gypsum shell (4). The gypsum shell (4) provides enough support to reliably hold the construction (1).

FIG. 3 shows a section of an inner wall (5) according to the invention that is made in a sandwich design. The inner wall (5) consists of two concrete Layers (6) with gypsum (7) between them. The concrete layers (6) are made of double walls (11). Each double wall (11) consists of prefabricated concrete panels with essentially parallel, spaced walls (12).

The walls (12) are connected with a wall lattice girder (13) that can be made of corrosion resistant steel or high-grade steel. The wall lattice girders (13) hold the walls (12) at a distance from each other and enable fast construction. The walls (12) are erected and form a type of permanent framework between which site-mixed concrete (14) is poured. This produces a compact concrete layer (6). The two concrete layers (6) can be connected to each other with a tie rod (15) for static reinforcement to prevent the concrete layers (6) from bulging when the gypsum (7) is poured in. The tie rod (15) is advantageously connected to the inside walls of the double walls (11) and not to the outside walls (12) to prevent radiation from entering the environment via the tie rods (15).

Instead of site-mixed concrete (14), gypsum or other materials can be poured into the double wall (11). This creates a certain connection between neighboring double walls and also improves radiation protection. The double walls (11) can either be connected by means of these fillers or by additional connecting means such as metal parts.

If several double walls (11) have to be joined to create the inner wall of the building, these double walls (11) can, for example, be welded at provided connecting sites to ensure a tight bond and prevent shifting while pouring the site-mixed concrete (14). When the double walls (11) are filled with site-mixed concrete (14), a seamless, uniform and continuous concrete layer (6) is obtained when several double walls (11) are used.

This invention is not limited to the portrayed exemplary embodiments. In particular, the sandwich design can be created using the two double walls (11) shown in FIG. 3, or a double wall (11) and a layer of site-mixed concrete, or a sheet wall, or simply the soil surrounding the building. The concrete layers (6) can be filled with special concrete that provides a certain degree of radiation protection. The thickness of the gypsum layer (7) can depend on the radiation protection requirements. It can range from a few centimeters to several meters. The concrete layer (6) is normally approximately 30 cm thick. However, this thickness can vary depending on the radiation protection requirements or static requirements. Another suitable material can be used as the anti-radiation layer in addition to the described gypsum, even though natural gypsum is held to be the most advantageous material at present since it is very economical. The thicknesses of the walls (12) of the double wall (11) can be the same or different. They can be made of conventional concrete or antiradiation concrete such as heavy concrete with iron additives.

What is claimed is:

1. A method for constructing a building designed for protection from radiation, said method comprising the steps of:

forming at least one of the walls of the building at a building site by constructing a concrete layer;

constructing an additional layer at the building site spaced from and opposite to the concrete layer;

subsequent to forming the concrete layer and additional layer, pouring a gypsum antiradiation material into the space defined between the concrete layer and the opposite additional layer such that the antiradiation material is constrained by the concrete layer and the opposite additional layer; and compressing the antiradiation material into the space between the concrete layer and the opposite additional layer material to form a layered sandwich configuration constructed at the building site wherein at least one layer of gypsum antiradiation material is poured and compressed against the concrete layer and the opposite additional layer.

2. The method as in claim 1, wherein the additional layer is formed from concrete or sheet pile during construction of the building.

3. The method as in claim 1, wherein the additional layer is a double-wall concrete structure formed at the building site.

4. The method as in claim 3, wherein the double-wall concrete structure is filled with site-mixed poured concrete.

5. The method as in claim 4, further comprising adding an antiradiation additive to the poured concrete.

6. The method as in claim 1, wherein the concrete layer and the additional layer are each formed at the building site as double-wall concrete structures that are filled with site-mixed concrete, the gypsum antiradiation material being subsequently poured and compressed between and against the double-wall concrete structures.

7. The method as in claim 6, further comprising connecting the double wall structures together with tie rods after construction thereof and before pouring and compressing the gypsum antiradiation material between and against the double-wall structures.

8. The method as in claim 6, wherein the double-wall structures are erected at the building site with concrete panels connected together with lattice girders.

9. The method as in claim 1, further comprising forming a base layer of antiradiation material at the building site upon which the wall is constructed, the layer of antiradiation material having sufficient structural integrity for supporting the wall.

10. The method as in claim 1, wherein the gypsum antiradiation material comprises water bound thereto.

11. The method as in claim 1, wherein the gypsum antiradiation material comprises natural, unfired calcium sulfate dehydrate.

12. The method as in claim 1, wherein the gypsum antiradiation material comprises granulated gypsum particles having a particle size of about 40 mm or smaller.

13. The method as in claim 1, further comprising adding at least one additive to the gypsum antiradiation material selected from the group of gibbsite, hydragilite, aluminum hydrate, and magnesium.

* * * * *